US008508764B2

(12) United States Patent
Dauer et al.

(10) Patent No.: US 8,508,764 B2
(45) Date of Patent: Aug. 13, 2013

(54) METHOD FOR TRANSMITTING DATA OF A PRINTING PRESS AND DIAGNOSTIC DEVICE

(75) Inventors: Lucia Dauer, Dossenheim (DE); Andreas Detmers, Heddesheim (DE); Jürgen Fitzer, Schriesheim (DE); Marcel Kiessling, Schwetzingen (DE); Klaus Kremer, Waghäusel (DE); Peter Marten, Heiligkreuzsteinach (DE); Gotthard Schmid, Malsch (DE)

(73) Assignee: Heidelberger Druckmachinen AG, Heidelberg (DE)

( * ) Notice: Subject to any disclaimer, the term of this patent is extended or adjusted under 35 U.S.C. 154(b) by 2272 days.

(21) Appl. No.: 10/000,692

(22) Filed: Nov. 15, 2001

(65) Prior Publication Data

US 2002/0057456 A1 May 16, 2002

(30) Foreign Application Priority Data

Nov. 15, 2000 (DE) ..... 100 56 719

(51) Int. Cl.

| | |
|---|---|
| ***G06F 3/12*** | (2006.01) |
| ***G06F 15/00*** | (2006.01) |
| ***G06F 3/00*** | (2006.01) |
| ***G03G 15/00*** | (2006.01) |

(52) U.S. Cl.

USPC ..... 358/1.15; 358/1.1; 399/24; 710/15

(58) Field of Classification Search

USPC ..... 358/1.15, 1.1; 399/24; 221/14; 710/15, 18, 19; 714/25, 30, 31, 39; 703/22

See application file for complete search history.

(56) References Cited

U.S. PATENT DOCUMENTS

| | | | | |
|---|---|---|---|---|
| 4,346,446 | A | 8/1982 | Erbstein et al. | |
| 4,905,054 | A | 2/1990 | Rood | |
| 5,305,199 | A | 4/1994 | LoBiondo et al. | |
| 5,325,156 | A | 6/1994 | Ulinski | |
| 5,414,494 | A | 5/1995 | Aikens et al. | |
| 5,715,496 | A | 2/1998 | Sawada et al. | |
| 6,003,078 | A | 12/1999 | Kodimer et al. | |
| 6,310,692 | B1 | 10/2001 | Fan et al. | |
| 6,405,178 | B1 * | 6/2002 | Manchala et al. | 705/29 |
| 6,798,997 | B1 * | 9/2004 | Hayward et al. | 399/12 |
| 6,892,317 | B1 * | 5/2005 | Sampath et al. | 714/4 |

FOREIGN PATENT DOCUMENTS

| | | | |
|---|---|---|---|
| DE | 237 282 | A1 | 7/1986 |
| EP | 0843229 | A2 | 5/1998 |
| EP | 0 914 968 | A2 | 5/1999 |
| FR | 2793443 | A1 * | 11/2000 |
| JP | 2259663 | A | 10/1990 |
| JP | 3-76651 | A | 4/1991 |
| JP | 4084231 | A | 3/1992 |
| JP | 6030146 | A | 2/1994 |
| JP | 08 011 294 | A | 1/1996 |
| JP | 09 052 353 | A | 2/1997 |
| JP | 2000025309 | A | 1/2000 |

* cited by examiner

*Primary Examiner* — Thomas Lett

(74) *Attorney, Agent, or Firm* — Laurence A. Greenberg; Werner H. Stemer; Ralph E. Locher

(57) ABSTRACT

A method and a diagnostic device for a printing press are described, wherein data is automatically transmitted by a central data processor of the printing press to a locally distanced central data processor when a threshold value is upwardly transgressed, downwardly transgressed or reached. The data is preferably assessed prior to the evaluation and/or the transmission to the remote central data processor. In this way, a simple telediagnostic service of the printing press is possible.

17 Claims, 2 Drawing Sheets

METHOD FOR TRANSMITTING DATA OF A PRINTING PRESS AND DIAGNOSTIC DEVICE

BACKGROUND OF THE INVENTION

Field of the Invention

The invention relates to a method for transmitting data of a printing press to a central data processor, whereby the data, particularly operating parameters of the printing press are acquired. The invention further relates to a diagnostic device for the printing press. The diagnostic device has a central data processor, a memory and a sensor that is allocated to the printing press. The sensor acquires the operating parameters and other data relating to the printing press.

Printing presses are extremely complicated and technically highly complex devices whose monitoring and maintenance make great demands upon service staff. Since printing presses are used at different locations where highly specialized technicians often are not available, it is desirable to transmit data of the printing press to a central data processor.

U.S. Pat. No. 5,325,156 discloses a method for generating a service call for a printing press, wherein an operating person starts a calling procedure. Given the calling procedure, data of the printing press is automatically transmitted to a central data processor. The identity of the printing press and the type of error are thereby transmitted. The transmission system offers interactive communication methods by which additional bits of information can be received or by which bits of status information can be displayed at the printing press.

SUMMARY OF THE INVENTION

It is accordingly an object of the invention to provide a method for transmitting data of a printing press and a diagnostic device which overcomes the above-mentioned disadvantages of the prior art methods and devices of this general type, in which a simpler method for transmitting data of the printing press and an improved diagnostic device for the printing press are provided.

With the foregoing and other objects in view there is provided, in accordance with the invention, a method for transmitting data. The method includes the steps of acquiring data relating to a printing press; comparing the data to at least one threshold value; and transmitting the data automatically to a central data processor when the threshold value is upwardly transgressed, downwardly transgressed or reached.

If the data acquired at the printing press is compared to a threshold value and if the data is automatically transmitted to a preferably locally distanced central data processor when the threshold value has been upwardly transgressed, downwardly transgressed or reached. A great advantage is that an automatic initialization of a service call can thereby occur and that an operator is not necessary, so that an automatic monitoring of the printing press is given. Whether a service call is necessary and whether service staff is potentially required, therefore, is no longer dependent on the assessment of an operator but is automatic by an evaluation of the critical data prescribed in terms of a program or by competent service staff monitoring the locally distanced central data processor.

The data is preferably evaluated before it is compared to a threshold value. Dependent on the result of the comparison, the evaluated data is automatically transmitted to the central data processor. For example, the operating parameters of the printing press thus can be evaluated before the data is transmitted to a central data processor. For example, a chronological average can also be calculated, so that the number of data transmissions to the central data processor can be reduced in this way.

Furthermore, an advantage is that different types of data are transmitted to the central data processor and are displayed together at the display of the central data processor. An operator monitoring the display of the central data processor thereby has the advantage of having a number of data types displayed at a screen. The operator, therefore, has a better overview of the operating mode of the printing press.

In a preferred embodiment, a chronological development of the data is calculated for future use and extrapolated for future requirements and the chronological development is transmitted to the central data processor. Therefore, an evaluation of the operating status of the printing press occurs and is extrapolated for future needs, which is automatically made available to the remotely disposed central data processor. As a result thereof, the central data processor and/or an operator can make a statement with respect to the further chronological development of the data and therefore can order corresponding measures such as maintenance services for the printing press.

A recommendation for service, for example, is preferably transmitted to the central data processor due to the present data. In an advantageous embodiment, a defective component of the printing press is detected on the basis of the data and an order for a replacement component is automatically transmitted to the central data processor. Preferably, an identification key of the printing press is also transmitted in order to be able to allocate the data to the printing press.

In another inventive embodiment, the data is compared to comparison data and the necessity of service needs is decided dependent on the comparison. This results in scheduled time between a central data processor of a customer and a central data processor of a service department being automatically coordinated. The appointment planning is thus automated.

With the foregoing and other objects in view there is provided, in accordance with the invention, a diagnostic device for a printing press. The diagnostic device includes a first central data processor, a memory for storing a threshold value that is connected to the first central data processor; a second central data processor connected to the first central processor; and a sensor connected to the first central data processor. The sensor acquires data including operating parameters of the printing press and transmits the data to the first central data processor. The first central data processor compares the data to the threshold value saved in the memory. The first central data processor automatically transmits the data to the second central data processor when the threshold value is upwardly transgressed, downwardly transgressed or reached.

In accordance with an added feature of the invention, the first central data processor calculates a chronological development of the data for future use. The first central data processor transmits the chronological development to the second central data processor.

In accordance with an additional feature of the invention, the first central data processor evaluates the data, and on a basis of the evaluation, determines a service recommendation for the printing press. The first central data processor transmits the service recommendation to the second central data processor.

In accordance with another feature of the invention, the first central data processor, on a basis of the data, detects a defective component of the printing press. The first central data processor automatically outputs an order for a replacement component to the second central data processor, and the first central data processor further transmits an identification of the printing press.

In accordance with a further feature of the invention, the first central data processor compares the data to comparison data. The first central data processor decides about a necessity of a service requirement in dependence on a relation of the data to the comparison data, and the first central data processor automatically arranges an appointment between a data processor of a customer and a data processor of a service department to fulfill the service requirement.

In accordance with a further added feature of the invention, the first central data processor evaluates the data, and automatically sends service data about the printing press to the second central data processor.

In accordance with a concomitant feature of the invention, the second central data processor is a locally distanced central data processor.

Other features which are considered as characteristic for the invention are set forth in the appended claims.

Although the invention is illustrated and described herein as embodied in a method for transmitting data of a printing press and a diagnostic device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
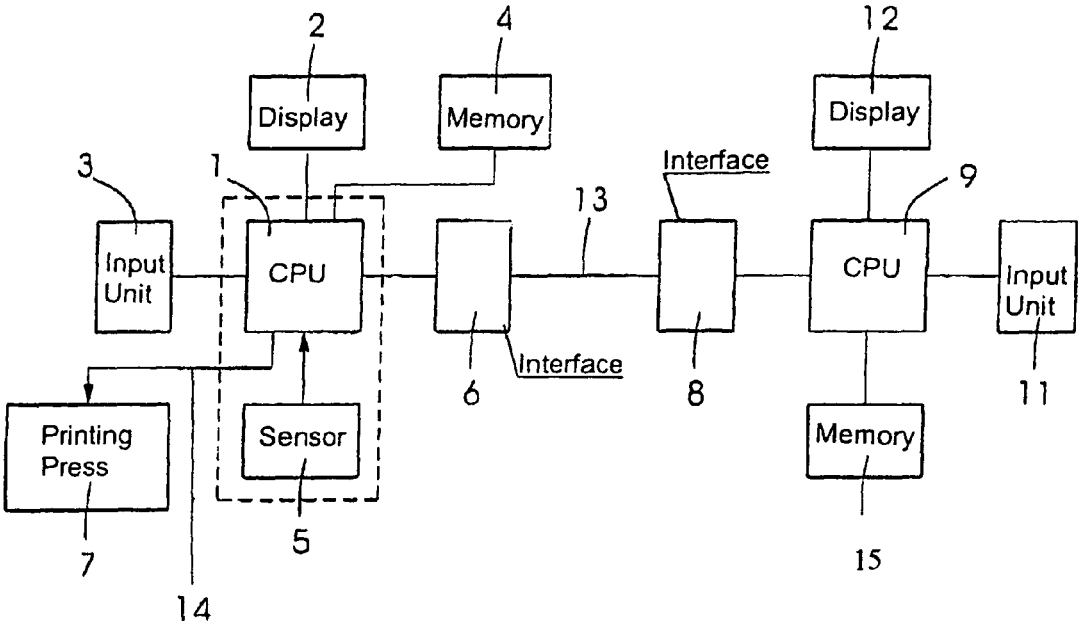
FIG. 1 is a block diagram showing a configuration having a printing press and a remotely disposed second central data processor.

Referring now to the figures of the drawing in detail and first, particularly, to FIG. 1 thereof, there is shown a first central data processor 1 that is allocated to a printing press 7, whereby the first central data processor 1 is connected to a sensor 5 which acquires data such as operating parameters or settings of the printing press 7 and forwards them to the first central data processor 1. The first central data processor 1 is coupled to the printing press 7 via a control line or, respectively, communication line 14 and thus is connected to the printing press 7. The first central data processor 1 controls the printing press 7 according to prescribed methods and/or data and communicates with the printing press 7.

The first central data processor is in connection with a first display 2, a first input 3, a first memory 4 and a first interface 6. The first interface 6, in turn, is connected to a data connection 13 that is led to a second interface 8. The second interface 8 is in connection with the second central data processor 9, which is connected to a second display 12, a second input 11 and a second memory 15. Preferably, the second central data processor 9 is locally remotely disposed from the printing press 7.

The data connection 13 can be fashioned, for example, in the form of a point-to-point telephone connection, an internet connection or an arbitrary network connection via a public network. The first interface 6 and the second interface 8 are fashioned for setting up a corresponding data circuit, for exchanging data via the data connection 13 and for forwarding them to the respective first central data processor 1 or, respectively, second central data processor 9.

The first display 2 and the second display 12 are fashioned in the form of a screen or a display, for example. The first input 3 and the second input 11, for example, represent a keyboard and/or screen with touch sensors, whereby the operation of a key is replaced by touching the touch sensors. The first central data processor 1 has diagnostic programs and monitoring programs, which are deposited in the first memory 4 and with which the first central data processor 1 preferably continuously monitors the functions of the printing press 7.

The first central data processor 1 having the first memory 4 and the sensor 5 represents a diagnostic device for the printing press 7, with which data of the printing press are acquired, so that an evaluation of the function status of the printing press 7 is possible.

Figure 2:
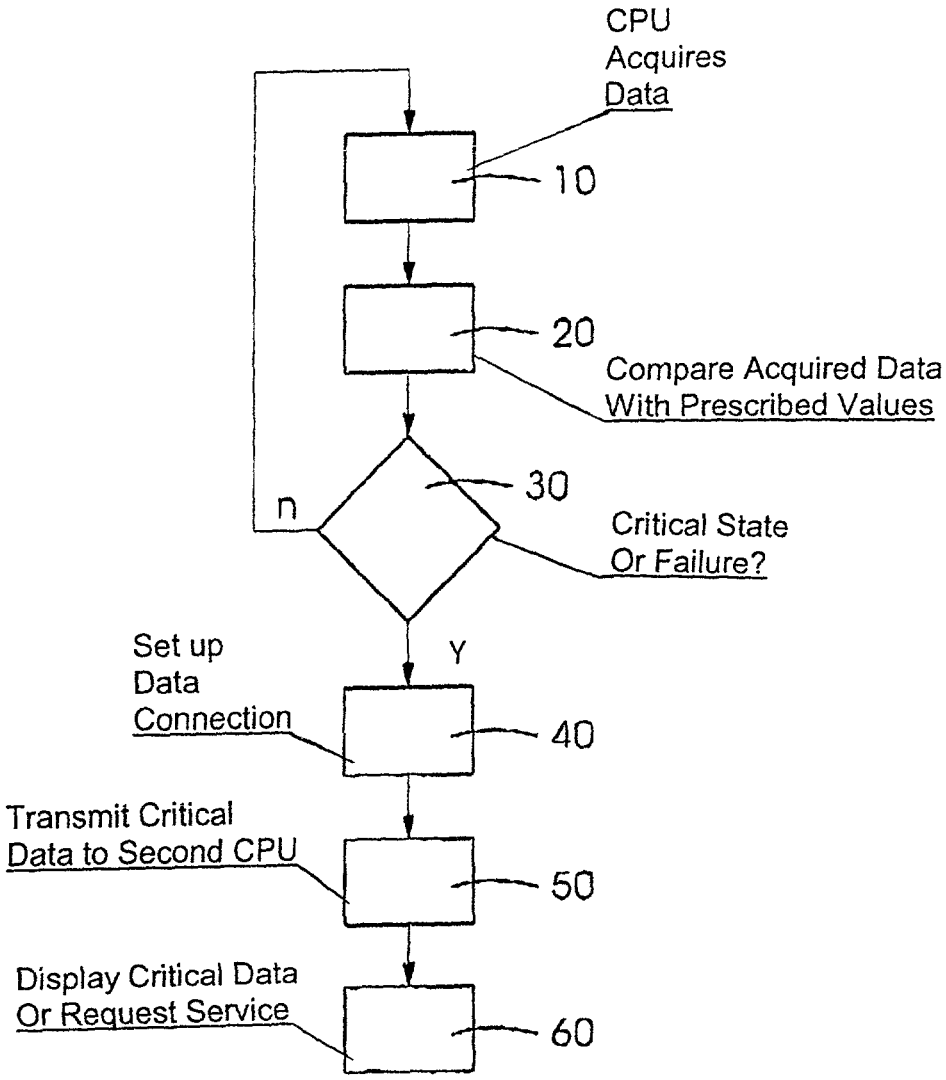
FIG. 2 is a flow chart of a program run for transmitting data.

The exact functioning of the configuration of FIG. 1 and the inventive method are subsequently explained in greater detail on the basis of the schematic program run of FIG. 2.

At program point 10, the first central data processor 1 acquires data, such as operating parameters and settings of the printing press 7, which makes it possible to make a statement about the functioning and/or defects or errors of the printing press 7.

At the following program point 20, the first central data processor 1 compares the acquired data with prescribed threshold values that are deposited in the first memory 4. It is subsequently checked at program point 30 whether an acquired datum is greater, smaller, or less than or equal to the corresponding threshold value. This depends on whether the upward transgression of a threshold value causes problems, whether the downward transgression of a threshold value is problematic or whether the reaching of a threshold value already represents a critical state. If a critical state is not present, it is branched back to program point 10. If it derives from the inquiry at program point 30 that a critical state is reached, it is branched to program point 40.

At program point 40, the first central data processor 1 automatically sets up the data connection 13, via the first interface 6, to the second interface 8 and to the second central data processor 9. Corresponding methods for setting up a data connection are thereby processed. The data connection can be realized in the form of a telephone connection or also in the form of an e-mail message, for example.

At the following program point 50, the critical data is transmitted to the second central data processor 9. At the following program point 60, the second central data processor 9 represents the transmitted data at the second display 12 in a simple manner. Given this representation, the critical data is preferably emphasized in terms of color, so that it is promptly recognized by an operator.

Besides, it is certainly possible to emphasize critical data in that different alarm signals ring. Thus, different sounding alarm signals can be allocated to particularly important data.

In a special embodiment of the invention, the first central data processor 1 acquires the data at program point 10 and additionally evaluates it. For example, the data is evaluated according to prescribed functions, with which an importance of the datum and/or the previous service life of the printing press are considered, for example. In this embodiment, the evaluated data are subsequently compared to corresponding threshold values at the program points 20 and 30, and the evaluated data at program point 50 is transmitted to the second central data processor 9 when the threshold values have been exceeded, after the setup of a data circuit corresponding to program point 40.

Different types of data are preferably transmitted to the second central data processor 9 and the different types of data are represented at the second display 12. Therefore, an operator has the different types of data available at first sight and therefore can better assess the overall condition of the printing press. For example, adjustment parameters of the printing press or measuring values acquired at the printing press are transmitted and displayed as the data. Adjustment parameters are the power distribution across a laser beam surface, the focusing of the laser beam and the reflection values of the printing plate, for example. Measuring values are the temperature and the service life of the printing press, for example.

In a preferred embodiment, the data is evaluated in that a chronological development of the data is calculated for future use and extrapolated and the chronological development is transmitted to the second central data processor 9 when a corresponding threshold value is exceeded. The second central data processor 9 thus has a statement with respect to the further development of the data and therefore can more precisely evaluate the functioning of the printing press. On the basis of the transmitted chronological development, the second central data processor 9 can automatically set up a service and/or can order a component part group and/or can set a service date, for example.

In another preferred embodiment, the first central data processor 1 evaluates the data to the effect whether service is necessary at the printing press. For this purpose, corresponding comparison values are deposited in the first memory 4. If the result of the evaluation is that a service is necessary, corresponding information is transmitted to the second central data processor 2 at the program point 50.

The chronological development of the data is preferably calculated in the first central data processor 1 which is provided with a number of data, operating parameters and/or adjustment values of the printing press 7 and which therefore can calculate the chronological development in a fast manner. As a result thereof, it is not necessary to transmit the data required for calculating the chronological development to the second central data processor 9.

In a further advantageous embodiment, the first central data processor 1, on the basis of the comparison at program point 30, determines whether a component of the printing press is defective. If the result of the comparison is that a component of the printing press is defective, an automatic connection to the second central data processor 2 is set up at program point 40 and information that a component is defective is subsequently transmitted, at program point 50, to the second central data processor 9. Preferably, an identification number for the defective component and an identification number for the printing press, in which the defective component is installed, are transmitted to the central data processor 9.

In another preferred embodiment, the first central data processor 1, at program point 20, compares the acquired data with comparison data and decides, dependent on a prescribed relation between the acquired data and the comparison data, whether service is necessary. If it results from the comparison at program point 30 that service is required or will be required, a data connection to the second central data processor 9 is automatically set up at program point 40.

At program point 50, an appointment for a service call is subsequently sent between a central data processor of a service department and a central data processor of a customer, which owns the printing press. A program such as Microsoft OUTLOOK® is used for entering a corresponding suggestion for an appointment into the appointment calendars of the customer and of the service department.

In a special embodiment of the invention, service data is transmitted at program point 50, via the printing press 7, to the second central data processor. For example, an operator, therefore, has further data about the printing press 7 at the central data processor 9. For example, a technician thus can promptly decide about further measures such as a repair of the printing press 7 without having to keep the corresponding records about the service data of the printing press 7 available at the location.

In a further embodiment of the invention, the second central data processor 9 processes the supplied data and determines, for example, the chronological development of the data on the basis of the supplied data or decides, by comparing corresponding threshold values, whether a component is already defective or will become defective within a measurable time. Moreover, the second central data processor 9 also can automatically produce a replacement order for the corresponding component at a further central data processor. The order is transmitted via an e-mail message, for example. On the basis of the present data and/or records, the second central data processor 9 can also make a decision about the necessity of services by a corresponding comparisons with comparison values. Given a corresponding decision about the necessity of services, the second central data processor 9 preferably coordinates the corresponding appointment with the central data processor of the customer, which owns the printing press 7, and with a central data processor of a corresponding service department. A program such as Microsoft OUTLOOK® is thereby used for entering the service utilization at the central data processor of the customer and the central data processor of the service department.

Another preferred embodiment does not only use a comparison of data at the program point 30 for deciding whether a data connection and a corresponding transmission of the data is to be automatically carried out, but a corresponding data connection is not set up and a corresponding data transmission is not carried out before different data is situated in a critical range.

We claim:

1. A method for transmitting data, which comprises the steps of:

acquiring data relating to a printing press from a sensor connected to a first central data processor located with the printing press and controlling the printing press via a control line;

the sensor transmitting the acquired data to a first central data processor allocated to the printing press;

calculating a chronological average of the acquired data in the first central data processor resulting in evaluated data, and subsequently comparing the evaluated data with at least one threshold value in the first central data processor; and transmitting the evaluated data and an identification key of the printing press automatically over the Internet from the first central data processor to a second central data processor locally distanced from the first central data processor when the threshold value is upwardly transgressed, downwardly transgressed or reached.

2. The method according to claim 1, which comprises:

during the acquiring step, acquiring different types of data and transmitting the different types of data to the second central data processor; and displaying the different types of data together on a display of the second central data processor.

3. The method according to claim 1, which comprises calculating a chronological development of the data for future use, and transmitting the chronological development to the second central data processor.

4. The method according to claim 3, which comprises displaying the data and emphasizing critical data during the displaying step.

5. The method according to claim 1, which comprises:

evaluating the data; and determining a need for service to the printing press on a basis of the evaluation, and transmitting a recommendation to the second central data processor.

6. The method according to claim 1, which comprises:

detecting a defective component of the printing press on a basis of the data;

automatically transmitting an order for a replacement component to the second central data processor, whereby an identification of the printing press is transmitted as well.

7. The method according to claim 1, which comprises comparing the data to comparison data, a service necessity is decided in dependence on a relation of the data to the comparison data, and an appointment between a data processor of a customer and a data processor of a service department is automatically arranged.

8. The method according to claim 1, which comprises:

evaluating the data; and sending service data about the printing press automatically to the second central data processor in dependence on a value of the data.

9. The method according to claim 1, wherein the data acquired relates to operating parameters of the printing press.

10. The method according to claim 1, which comprises comparing the data to a plurality of threshold values.

11. The method according to claim 1, which comprises calculating a chronological development of the data including extrapolating future data trends, and transmitting the chronological development to the second central data processor.

12. A diagnostic device for a printing press, comprising:

a first central data processor located with the printing press for controlling the printing press via a control line;

a sensor connected to the first central data processor allocated to the printing press;

a memory for storing a threshold value and connected to said first central data processor; and a second central data processor being locally distanced from said first central data processor and connected to said first central data processor through the internet;

said first central data processor configured to calculate a chronological average of the acquired data resulting in evaluated data and subsequently compare the evaluated data with at least one threshold value saved in said memory; and said first central data processor configured to automatically transmit the evaluated data and an identification key of the printing press over the internet to the second central data processor when the threshold value is upwardly transgressed, downwardly transgressed, or reached.

13. The diagnostic device according to claim 12, wherein said first central data processor calculates a chronological development of the data for future use, said first central data processor transmitting the chronological development to said second central data processor.

14. The diagnostic device according to claim 12, wherein said first central data processor evaluates the data, and on a basis of an evaluation, determines a service recommendation for the printing press, said first central data processor transmits the service recommendation to said second central data processor.

15. The diagnostic device according to claim 12, wherein said first central data processor, on a basis of the data, detects a defective component of the printing press, and said first central data processor automatically outputs an order for a replacement component to said second central data processor, said first central data processor further transmitting an identification of the printing press.

16. The diagnostic device according to one claim 12, wherein said first central data processor compares the data to comparison data, said first central data processor decides about a necessity of a service requirement in dependence on a relation of the data to the comparison data, and said first central data processor automatically arranges an appointment between a data processor of a customer and a data processor of a service department to fulfill the service requirement.

17. The diagnostic device according to claim 12, wherein said first central data processor evaluates the data, and automatically sends service data about the printing press to said second central data processor.

* * * * *